US007976773B2

(12) United States Patent
Jung et al.

(10) Patent No.: US 7,976,773 B2
(45) Date of Patent: Jul. 12, 2011

(54) DEGASSING APPARATUS HAVING DUPLEX VACUUM VESSEL

(75) Inventors: Byung-Kyu Jung, Kyungsangbook-do (KR); Han-Yung Kal, Kyungsangbook-do (KR); Jin-Ho Son, Kyungsangbook-do (KR); Young-Sik Shin, Kyungsangbook-do (KR); Uel-Duk Jin, Kyungsangbook-do (KR); Kyung-Bae Jin, Kyungsangbook-do (KR); Jae-Kyu Kim, Kyungsangbook-do (KR); Chai-Rok Lee, Kyungsangbook-do (KR)

(73) Assignee: Posco Engineering & Construction Co., Ltd., Pohang, Kyungsangbook-do (KR)

( * ) Notice: Subject to any disclaimer, the term of this patent is extended or adjusted under 35 U.S.C. 154(b) by 428 days.

(21) Appl. No.: 12/159,615

(22) PCT Filed: Dec. 20, 2006

(86) PCT No.: PCT/KR2006/005592

§ 371 (c)(1),
(2), (4) Date: Jul. 18, 2008

(87) PCT Pub. No.: WO2007/074993

PCT Pub. Date: May 7, 2007

(65) Prior Publication Data

US 2008/0296812 A1 Dec. 4, 2008

(30) Foreign Application Priority Data

Dec. 29, 2005 (KR) ..... 10-2005-0133088

(51) Int. Cl.
*C12C 7/00* (2006.01)

(52) U.S. Cl. ..... 266/209; 266/207

(58) Field of Classification Search ..... 266/207, 266/208, 209
See application file for complete search history.

(56) References Cited

U.S. PATENT DOCUMENTS

2008/0296812 A1* 12/2008 Jung et al. ..... 266/215

FOREIGN PATENT DOCUMENTS

JP 55-100918 8/1980
JP 62-17117 1/1987

(Continued)

OTHER PUBLICATIONS

Machine translation of JP 06293907A Oct. 1994.*

*Primary Examiner* — Scott Kastler
(74) *Attorney, Agent, or Firm* — McDermott Will & Emery LLP

(57) ABSTRACT

A degassing apparatus having duplex vacuum vessels for removing impurity gases from molten steel by backflow of molten steel thereby homogenizing molten steel composition. The apparatus includes duplex vacuum vessels of first and second vacuum vessels fixedly arranged at a predetermined interval to a floor which is provided horizontally at a predetermined height from a bottom; first and second ladle carriages arranged to run on first and second rails, respectively, to reciprocate between a treatment position directly under the first and second vacuum vessels and a tapping position where refined molten steel is tapped, each of the first and second ladle carriage loaded with a corresponding one of first and second ladles; and first and second lifting cylinders each for raising and lowering each of the first and second ladles in the treatment position so that a bottom end of each of the first and second vacuum vessels is immersed by molten steel in each of the first and second ladles. The apparatus can remove limiting factors of suspending a continuous vacuum degassing refining process and thus prolong lifetime of the vacuum vessel and save manufacturing cost.

4 Claims, 7 Drawing Sheets

FOREIGN PATENT DOCUMENTS

| | | | |
|---|---|---|---|
| JP | 5-9550 | | 1/1993 |
| JP | 06293907 | A * | 10/1994 |
| JP | 2000-87129 | | 3/2000 |
| JP | 2003-105430 | | 4/2003 |

* cited by examiner

[Fig. 1]
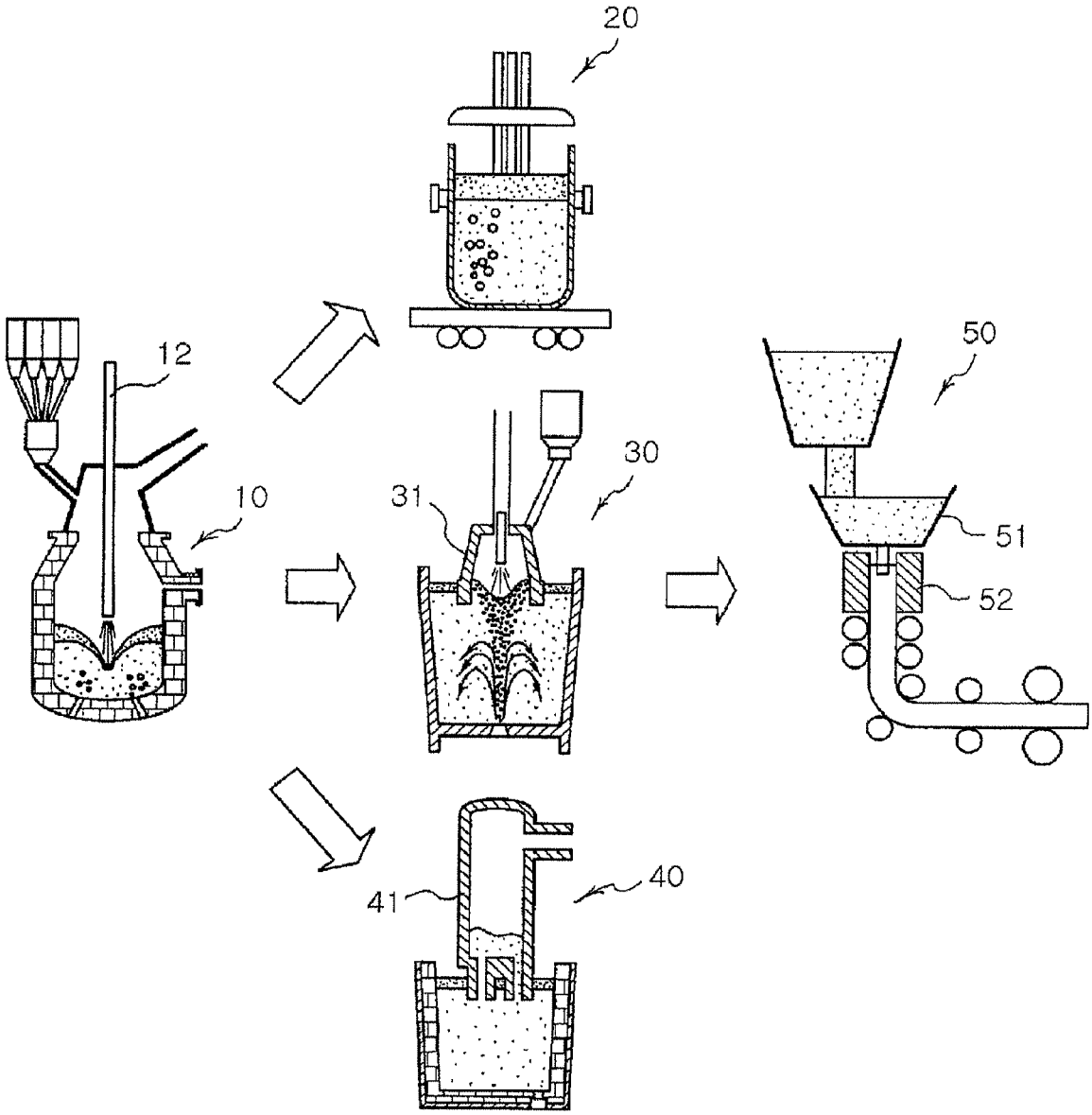
(PRIOR ART)

[Fig. 2]
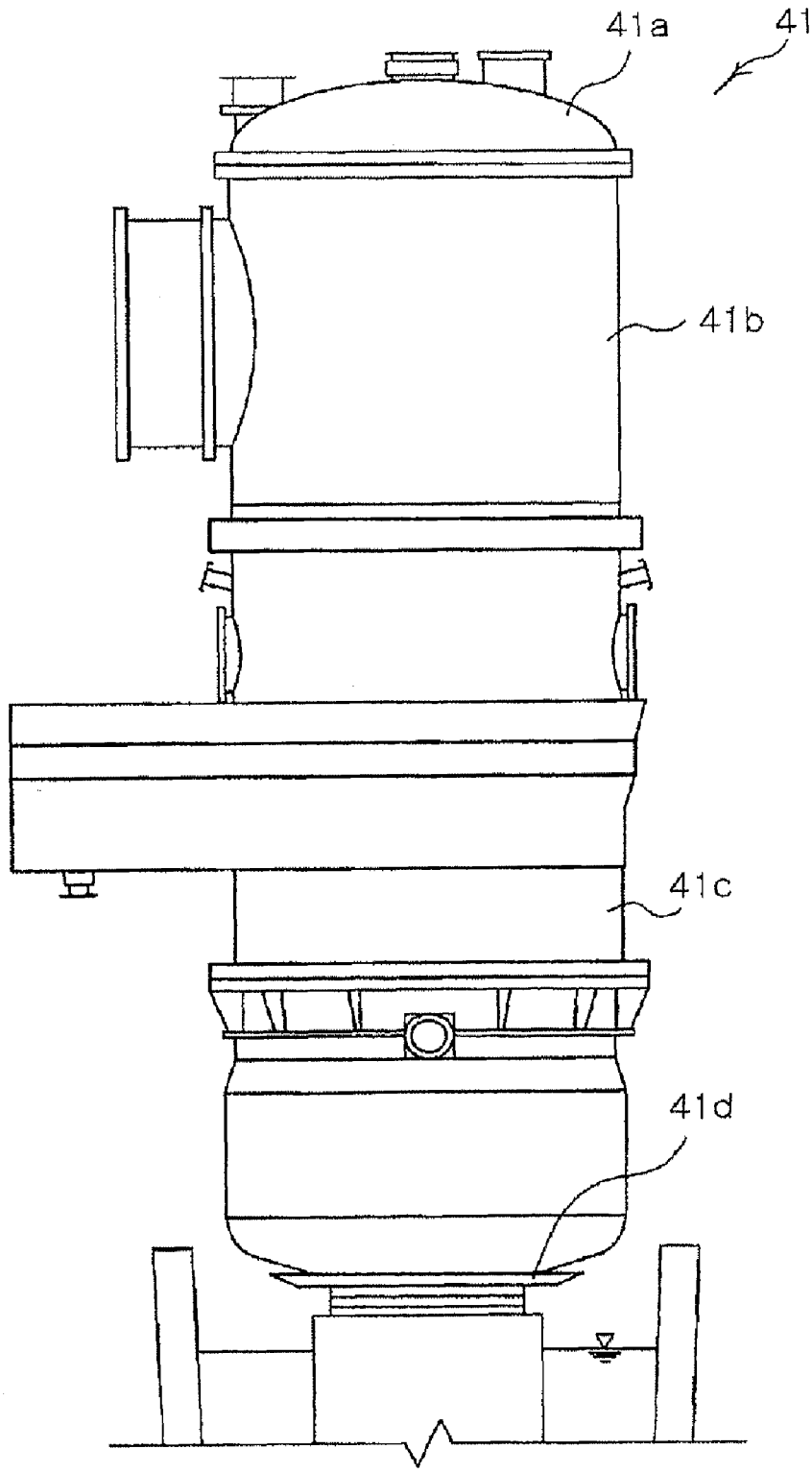
(PRIOR ART)

[Fig. 3]
(a)
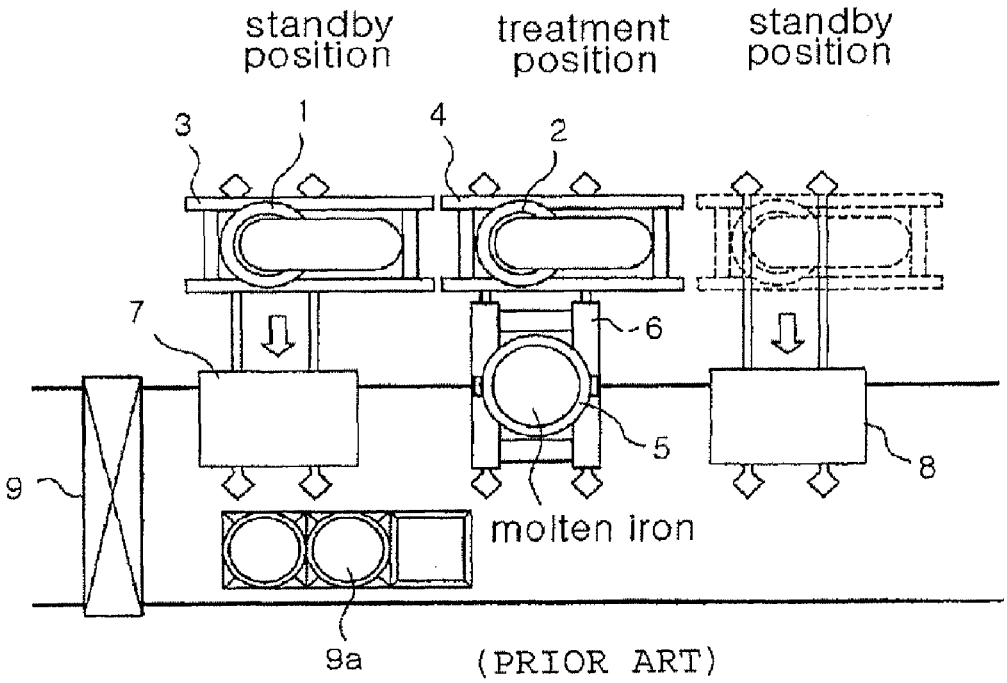
(PRIOR ART)
(b)
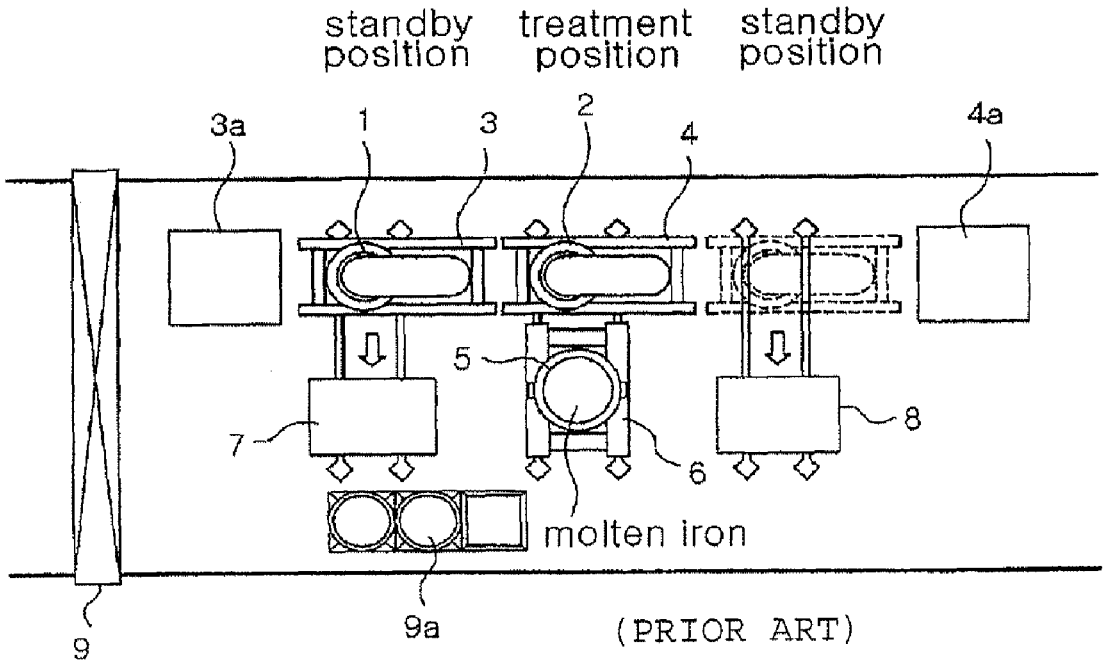
(PRIOR ART)

[Fig. 4]
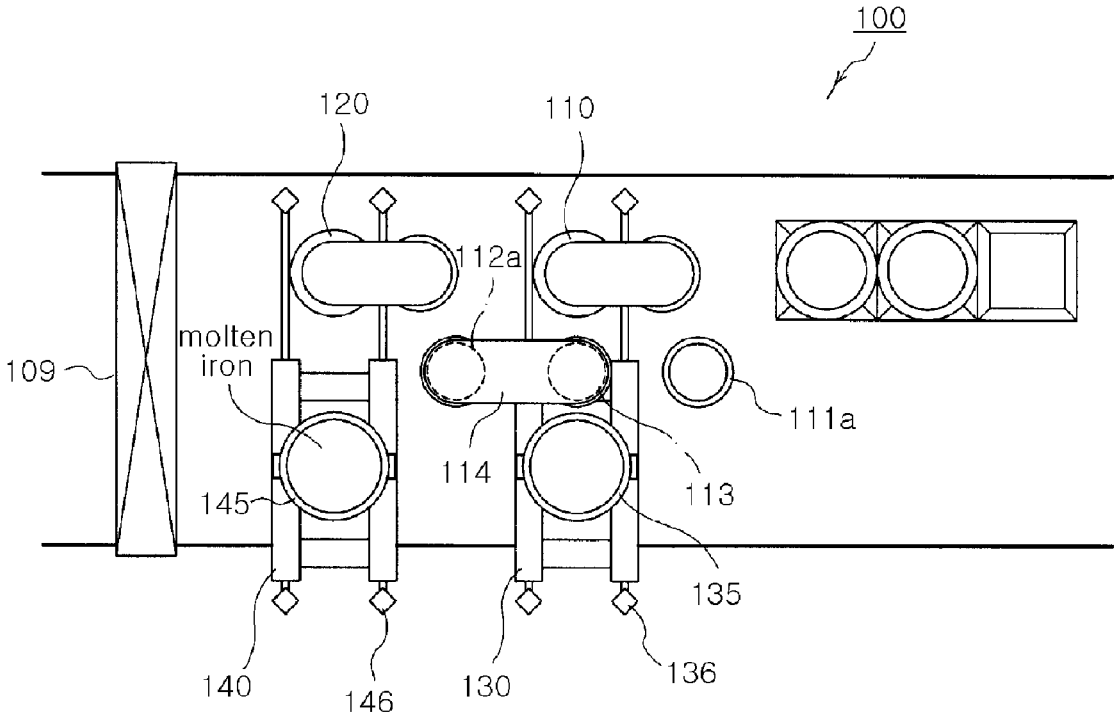

[Fig. 5]
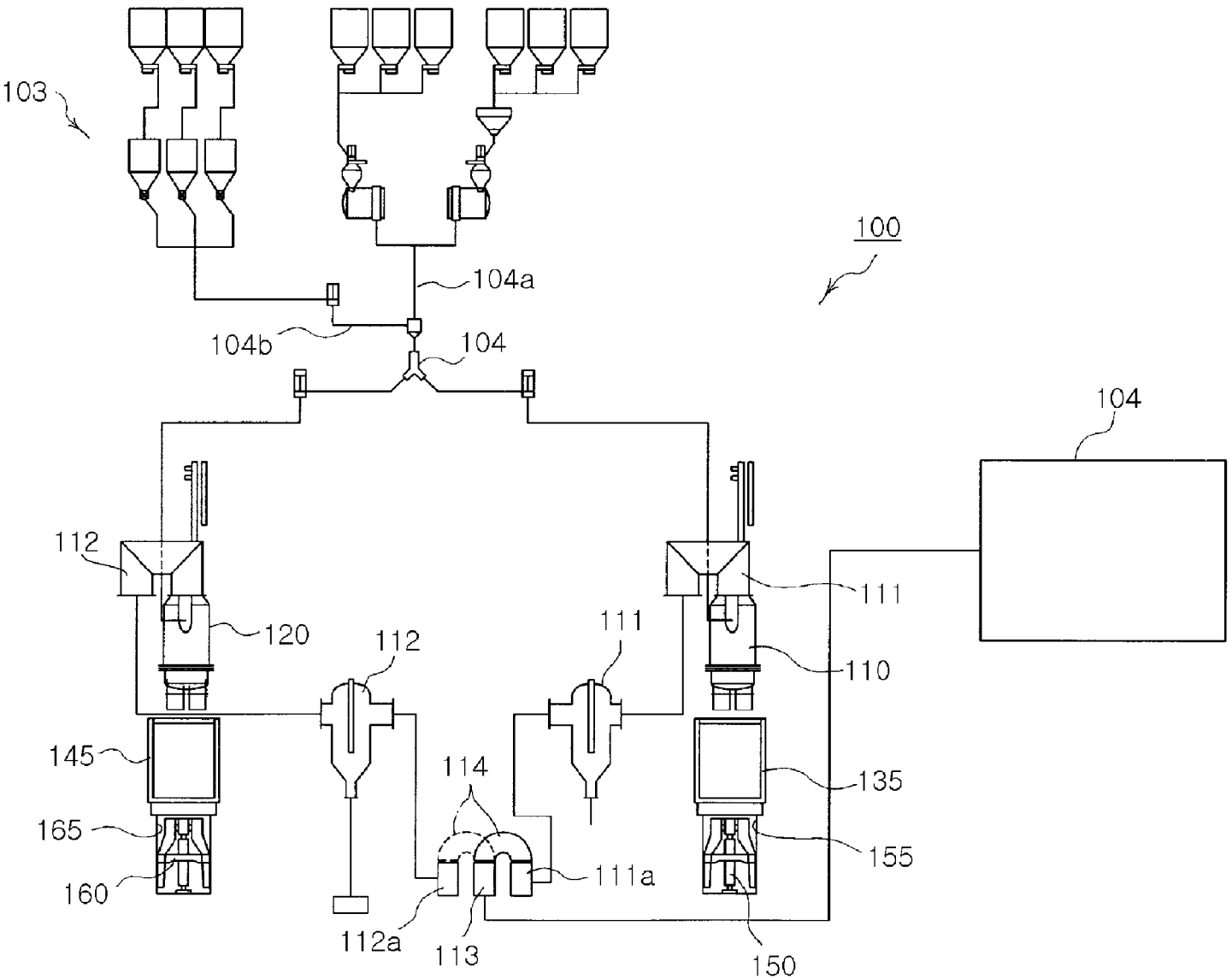

[Fig. 6]
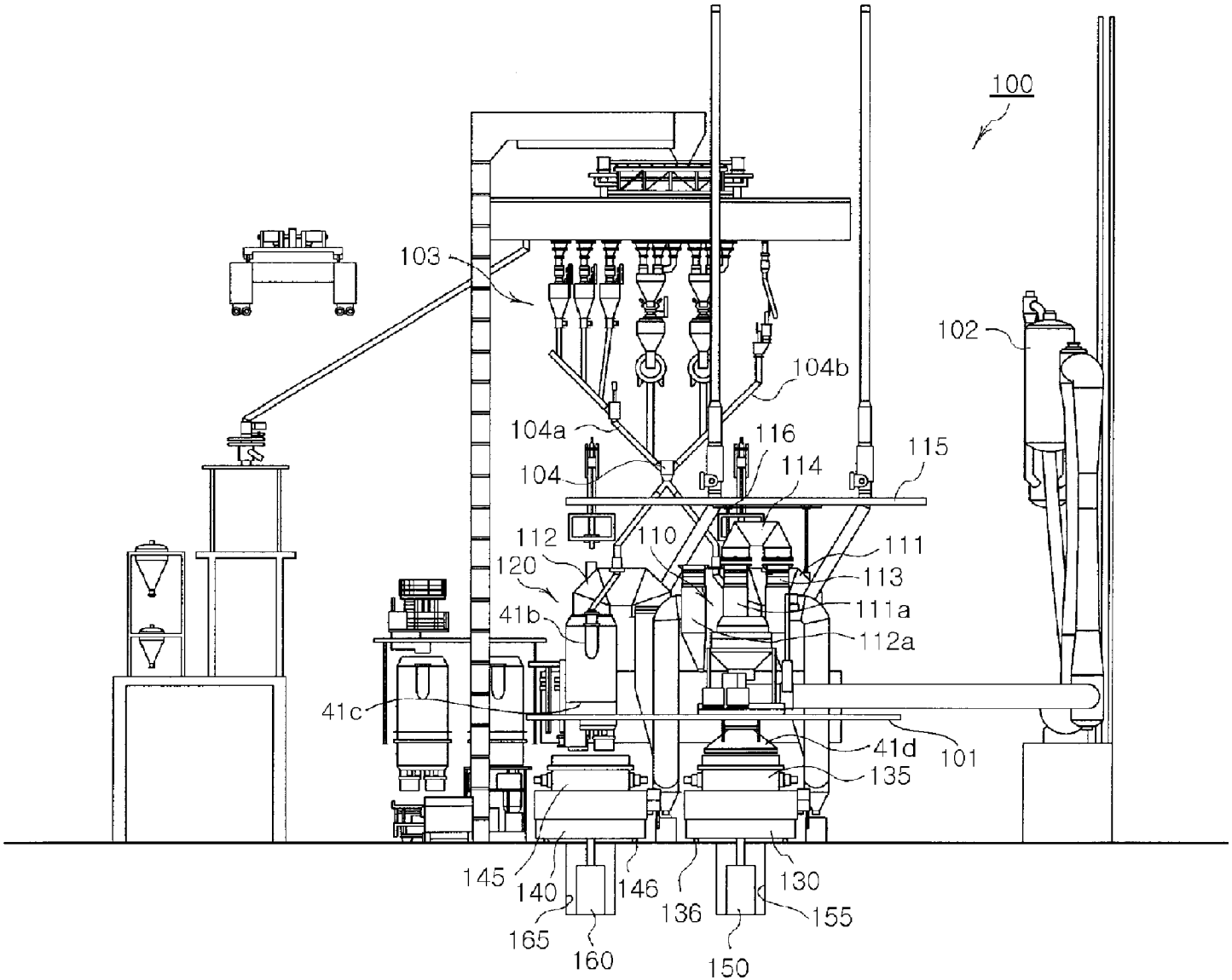

[Fig. 7]
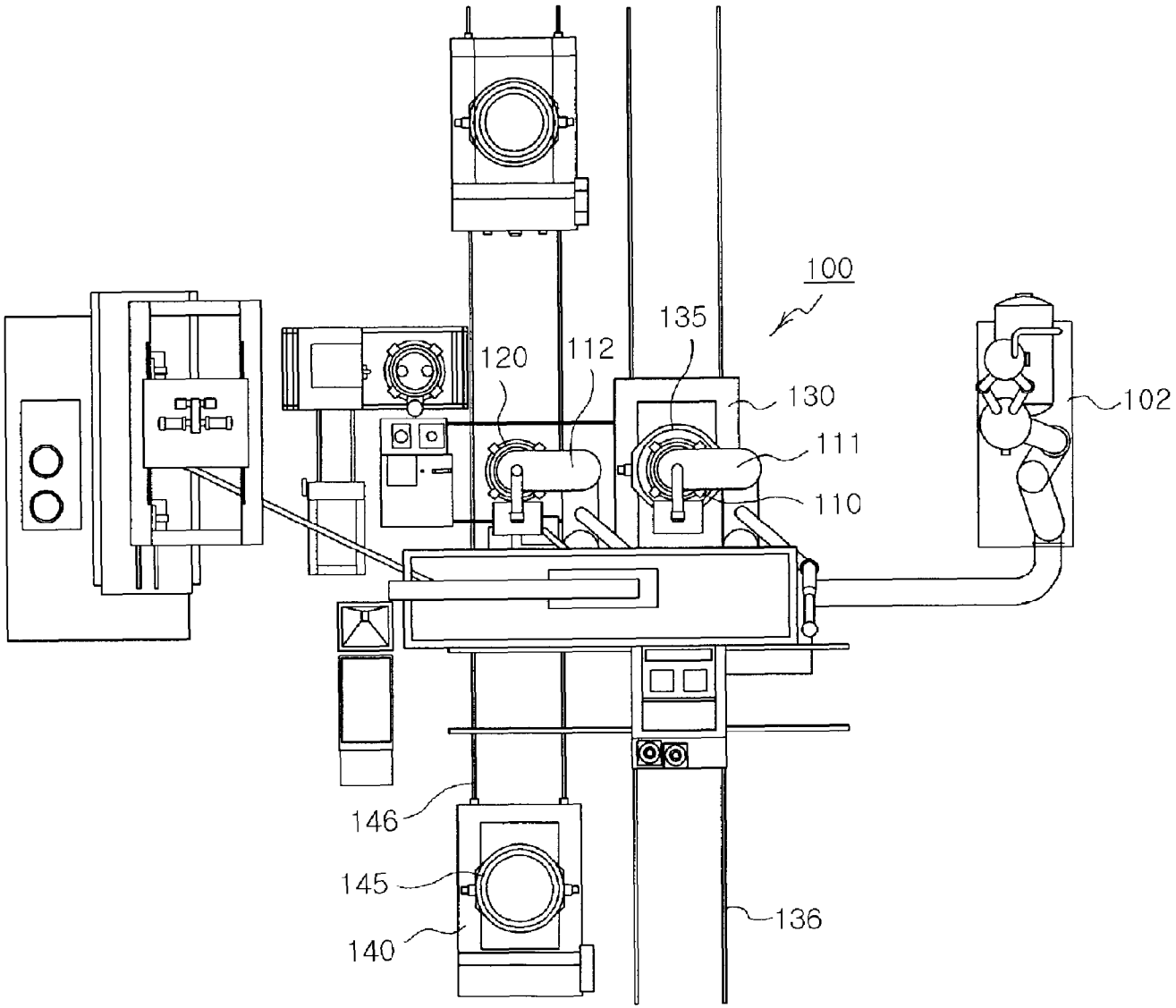

DEGASSING APPARATUS HAVING DUPLEX VACUUM VESSEL

TECHNICAL FIELD

The present invention relates to a degassing apparatus having duplex vacuum vessels, in particular, which can remove limiting factors of suspending a continuous vacuum degassing refining process and thus prolong lifetime of the vacuum vessel and save manufacturing cost.

BACKGROUND ART

In general, smelting refers to a process of reducing iron ores into pig iron in a blast furnace and steel making refers to a process of delivering molten pig iron, discharged from a tap of the furnace, to a converter to refine the molten pig iron (and remove impurities therefrom) thereby making molten steel.

Such a steel making process is divided into a first process of converting pig iron into molten steel and a secondary process of refining molten steel by controlling temperature and composition.

FIG. 1 illustrates the flow of general steel making and continuous casting processes. As shown in FIG. 1, pig iron produced by melting iron ores in a blast furnace is desulfurized and dephosphorized in an iron preparation process and delivered into a converter 10 for a converter process. In the converter process, pure oxygen is blown to the pig iron through an oxygen lance 12 to reduce carbon content to about 0.04% by weight, thereby producing molten steel removed of carbon.

Molten steel is tapped from the converter 10 into a ladle furnace 20 at a low temperature, by which its composition is controlled by reduction in P content, and then heated again.

Alternatively, by the use of molten steel heater 30 such as Chemical heating In Snorkel (CHIS) equipment and CAS-OP equipment, molten steel is heated with improved efficiency to delicately control the composition. This is novel secondary refiner that uses a snorkel 31 or an enclosed vessel sealed from the external air in order to cause chemical reaction between Al and oxygen, thereby raising the temperature of molten steel.

In addition, for the purpose of refining, molten steel may be delivered to Rurhstahl AG & Heraus Oxygen Blowing (RH-OB) equipment 40, one type of vacuum degassing refiners for the production of high purity steel. The RH-OB equipment 40 is another type of secondary refiner for extracting gases such as CO, nitrogen and hydrogen from molten steel through the backflow of molten steel in a vacuum vessel 41, controlling the temperature to enable continuous casting, and homogenizing the composition of molten steel.

Upon having been refined through the converter and secondary refining processes as described above, molten steel is supplied to continuous casting equipment 50, which makes slab from molten steel by continuous casting through a turn dish 51 and a mold 52.

FIG. 2 is a side elevation view illustrating a vacuum vessel 41 installed in a general vacuum degassing refiner. Referring to FIG. 2, the vacuum vessel 41 includes a top cover 41*a*, an upper vacuum vessel 41*b*, a lower vacuum vessel 41*c* and a snorkel 41*d*.

FIGS. 3 (*a*) and (*b*) illustrate layouts of vacuum degassing refiners using two vacuum vessels 1 and 2 having such a structure, in which FIG. 3(*a*) is known as Japanese type and FIG. 3 (*b*) is known as European type.

It is referred to as a treatment position that the vacuum vessels 1 and 2 are arranged along the movement line of a ladle carriage 6 on which the ladle 5 filled with molten steel is loaded, and as a repair position that the vacuum vessels 1 and 2 are arranged along the movement line of repair carriages 7 and 8 for the purpose of the replacement or repair of the lower vacuum vessel and the snorkel.

That is, according to a conventional process performed in the vacuum degassing refiner as shown in FIGS. 3 (*a*) and (*b*), the ladle carriage 6 is driven to the treatment position to be located directly under the second vacuum vessel 2, the ladle 5 is raised to such a level that the bottom of the second vacuum vessel 2 is immersed with molten steel of the ladle 5, and then impurities are removed from molten steel.

Upon the completion of molten steel degassing, the ladle 5 is lowered from the raised position and seated on the ladle carriage 6, and then the ladle carriage 6 is driven to the tapping position for the tapping of refined molten steel.

During the vacuum degassing refining process as above, in case of Japanese type as shown in FIG. 3 (*a*), the lower vacuum vessels of the first vacuum vessels 1 and the snorkels are carried out to and in from a repair site 9*a* and the upper vacuum vessels fixed to vacuum vessel carriages 3 and 4 are repaired in the standby position.

In case of European type as shown in FIG. 3 (*b*), the snorkels are replaced with new ones by means of snorkel replacing carriages 3*a* and 4*a* in the standby position. The lower vacuum vessels are detached/attached by means of separate hydraulic equipment, and the repaired snorkels and lower and upper vacuum vessels are carried out to and in from a repair site by a repair crane 9.

The degassing refining has to be stopped in a process of replacing the snorkel or lower vacuum vessel in the treatment position or repairing the snorkel by the use of a spray gunning machine or hot frame gunning machine while the vacuum vessel is being repaired.

Thus, a long time is necessary to replace the snorkel or lower vacuum vessel with a new one or repair the snorkel. This, however, acts as major factors of shortening the work hours of the vacuum degassing refiner having limited average work times of 20 to 28, lowering productivity and raising manufacturing costs.

DISCLOSURE OF INVENTION

Technical Problem

The present invention has been made to solve the foregoing problems of the prior art and therefore an aspect of the present invention is to provide a degassing apparatus having duplex vacuum vessels, in particular, which can remove limiting factors of suspending a continuous vacuum degassing refining process and thus prolong lifetime of the vacuum vessel and save manufacturing cost.

Technical Solution

According to an aspect of the invention, the invention provides a vacuum degassing apparatus for removing impurity gases from molten steel by backflow of molten steel thereby homogenizing molten steel composition. The apparatus includes duplex vacuum vessels of first and second vacuum vessels fixedly arranged at a predetermined interval to a floor which is provided horizontally at a predetermined height from a bottom; first and second ladle carriages arranged to run on first and second rails, respectively, to reciprocate between a treatment position directly under the first and second vacuum vessels and a tapping position where refined molten steel is tapped, each of the first and second ladle carriage loaded with a corresponding one of first and second ladles; and first and second lifting cylinders each for raising and lowering each of the first and second ladles in the treatment position so that a bottom end of each of the first and second vacuum vessels is immersed by molten steel in each of the first and second ladles.

Preferably, the first and second vacuum vessels are arranged to communicate first and second gas coolers, respectively, and the apparatus further includes: a vacuum duct extending from a vacuum equipment and arranged between first and second exhaust ducts extending respectively from the first and second gas coolers, and a switching duct configured to reciprocate between the first exhaust duct and the vacuum duct and between the second exhaust duct and the vacuum duct.

More preferably, the switching duct includes an overturned U-shaped duct member connected to a duct carriage by means of a chain member, the duct carriage arranged to reciprocate on a horizontal rail.

Preferably, the first and second vacuum vessels are arranged to communicate with an alloy iron source by means of first and second charging ducts, and the apparatus further includes a dispenser arranged at a point where the charging ducts intersect each other, the dispenser configured to convert a supply path of alloy iron in order to selectively supply ally iron to one of the first and second vacuum vessels.

Preferably, the first and second lifting cylinders are arranged in first and second pits, respectively, which are dug to a predetermined depth into bottom portions directly under the first and second vacuum vessels.

Advantageous Effects

According to the present invention as set forth above, the first and second vacuum vessels are arranged on the floor located at a predetermined height from the bottom, and the vacuum equipment for generating vacuum suction force is connected selectively with one of the first and second vacuum vessels. Owing to this construction, while a vacuum degassing process is being performed to molten steel by using one of the vacuum vessels, repair and/or replacement can be performed to the other vacuum vessel. As a result, this can remove limiting factors that suspend a continuous vacuum degassing refining process, and thus prolong lifetime of the vacuum vessel and saving manufacturing cost.

BRIEF DESCRIPTION OF THE DRAWINGS

FIG. 1 is process diagram illustrating the flow of general steel making and continuous casting processes;

FIG. 2 is a side elevation view illustrating a vacuum vessel installed in a general vacuum degassing refiner;

FIGS. 3 (*a*) and (*b*) are a schematic view illustrating conventional vacuum degassing refiners;

FIG. 4 is a schematic view illustrating a vacuum degassing apparatus having duplex vacuum vessels according to the invention;

FIG. 5 is a conceptual diagram illustrating the vacuum degassing apparatus having duplex vacuum vessels according to the invention;

FIG. 6 is a front elevation view illustrating the vacuum degassing apparatus having duplex vacuum vessels according to the invention; and FIG. 7 is a plan view illustrating the vacuum degassing apparatus having duplex vacuum vessels according to the invention.

BEST MODE FOR CARRYING OUT THE INVENTION

Exemplary embodiments of the present invention will now be described more fully hereinafter with reference to the accompanying drawings.

FIG. 4 is a schematic view illustrating a vacuum degassing apparatus having duplex vacuum vessels according to the invention, FIG. 5 is a conceptual diagram illustrating the vacuum degassing apparatus having duplex vacuum vessels according to the invention, FIG. 6 is a front elevation view illustrating the vacuum degassing apparatus having duplex vacuum vessels according to the invention, and FIG. 7 is a plan view illustrating the vacuum degassing apparatus having duplex vacuum vessels according to the invention.

Referring to FIGS. 4 to 7, the exemplary vacuum degassing apparatus 100 according to the invention can carry out a process of removing impurity gases such as CO, nitrogen and hydrogen from molten steel contained in a ladle by the backflow of molten steel in a vacuum atmosphere thereby producing high purity steel, continuously without any suspension in the process even in the replacement or repair of a snorkel and/or vacuum vessel, and includes first and second vacuum vessels 110 and 120, first and second ladle carriages 130 and 140 and first and second lifting cylinders 150 and 160.

The first and second vacuum vessels 110 and 120 are vacuum equipments fixedly installed with a predetermined distance to a floor 101 that is distanced at a pre-determined height from and in parallel with the bottom on which the first and second ladle carriages 130 and 140 are run.

Each of the first vacuum vessels 110 and 120 includes a top cover 41*a*, an upper vacuum vessel 41*b*, a lower vacuum vessel 41*c* and a snorkel 41*d* as in the prior art.

The floor 101 is of a horizontal structure provided to a vertical structure that is perpendicular to the bottom so that the lower vacuum vessels 41*c* of the first and second vacuum vessels 110 and 120 are exposed to downside.

Accordingly, immersing pipes provided in lower portions of the lower vacuum vessels 41*c* and the snorkels covering the first and second ladles 135 and 145 are located under the floor 101 but the upper vacuum vessels 41*b* is located above the floor 101. The upper vacuum vessels 41*b* are connected to vacuum equipment 102 via first and second gas coolers 111 and 112 for cooling and de-dusting hot exhaust gas, which is exhausted out in vacuum degassing of molten steel.

The first and second carriages 130 and 140 are loaded with the first and second ladles 135 and 145, which are filled with molten steel to a predetermined amount, and arranged on first and second rails 136 and 146, which are spaced from each other to a predetermined interval to run directly under the first and second vacuum vessels 110 and 120, respectively.

Accordingly, the first and second ladle carriages 130 and 140 reciprocate between a treatment position for degassing molten steel contained in the first and second ladles 135 and 145 by the backflow molten steel, located directly under the first and second vacuum vessels 110 and 120, and a tapping position for discharging degassed molten steel.

The first lifting cylinder 150 is a cylinder member adapted to raise only the first ladle 135 on the first carriage 130 to move in the direct upward direction so as to immerse the lower end of the first vacuum vessel 110 with molten steel in the first ladle 135 or lower only the first ladle 135 to be seated on the first carriage 130 in order to tap degassed molten steel when the first ladle carriages 130 stops at the treatment positions directly under the first and second vacuum vessel 110. The second lifting cylinder 160 is also a cylinder member adapted to perform the same function as the first lifting cylinder 150 when the second ladle carriage 140 stops at the treatment positions directly under the second vacuum vessel 120.

Here, the first and second lifting cylinders 150 and 160 are arranged respectively in the first and second pits 155 and 165 which are dug to a predetermined depth in bottom portions directly under the first and second vacuum vessels 110 and 120.

The first and second vacuum vessels 110 and 120 are arranged to communicate with an alloy iron source 103 via first and second charging ducts 104*a* and 104*b*. During the backflow of molten steel caused by backflow gas blown thereto, molten steel can be degassed and cleared of impurities to have high purity as well as to be controlled in composition to a level desirable by consumers. A dispenser 104 is installed at a point where the charging ducts 104*a* and 104*b* intersect each other so that alloy iron can be supplied selectively to one of the first and second vacuum vessels 110 and 120 which perform a vacuum degassing process.

Accordingly, alloy steel discharged from the alloy iron source 103 is charged into the first and second vacuum vessels 110 and 120 respectively through the first and second charging ducts 104*a* and 104*b* to be inputted into molten steel which is raised and being degassed.

In addition, the first and second vacuum vessels 110 and 120 communicate with the first and second gas coolers 111 and 112, respectively, so that dust can be removed from exhaust gas in vacuum degassing of molten steel. A vacuum duct 113 extending from the vacuum equipment 102, which is adapted to generate a predetermined strength of vacuum suction force, is arranged between first and second exhaust ducts 111*a* and 112*a* extending respectively from the first and second gas coolers 111 and 112. A switching duct 114 is arranged in a position directly above the first and second exhaust ducts 111*a* and 112*a* and the vacuum duct 113, and adapted to reciprocate and communicate between the first exhaust duct 111*a* and the vacuum duct 113 or the second exhaust duct 112*a* and the vacuum duct 113 according to the operating condition of the first and second vacuum vessels 110 and 120.

The switching duct 114 is an overturned U-shaped duct member connected to a duct carriage 116 by means of a chain member or cylinder, and the duct carriage 116 is arranged to reciprocate along a horizontal rail 115 provided above the first and second vacuum vessels 110 and 120.

In case of attempting to continuously perform a degassing process of removing impurity gas from molten steel in the ladle by selecting one of the first and second vacuum vessels 110 and 120 of the apparatus 100 of the invention, the first ladle 135 is seated on the first ladle carriage 130 by using a crane.

Then, the first ladle carriage 130 is driven to a predetermined distance along the first rail 136 and then stopped so that the first ladle 135 is located at the treatment position directly under the first vacuum vessel 110.

The first ladle 110 on the first ladle carriage 130 remaining at the treatment position is raised to a predetermined height by the elevation of the first lifting cylinder 150 provided in the first pit 155 corresponding to a position directly under the first vacuum vessel 110.

Accordingly, the bottom end of the first vacuum vessel 110 is immersed in molten steel in the raising first ladle 135.

In the meantime, in order to perform vacuum degassing onto molten steel in the first ladle 135 by the use of the first vacuum vessel 10, the first vacuum vessel 110 is required to communicate with the vacuum equipment 102 so that vacuum suction force occurring in response to the actuation of the vacuum equipment 102 can be transferred to the inside space of the first vacuum vessel 110.

That is, the duct carriage 116 adapted to reciprocate along the horizontal rail 115 is driven so that the switching duct 114 connected to the duct carriage 116 is located directly above the first exhaust duct 111*a* extending from the first gas cooler 111 connected to the first vacuum vessel 110 and the vacuum duct 113 extending from the vacuum equipment 102.

When the switching duct 113 is lowered from this position, the first vacuum vessel 110 communicates with the vacuum vessel 102 via the first gas cooler 111, the first exhaust duct 111*a*, the switching duct 114 and the vacuum duct 113.

Accordingly, a watering pump (not shown) of the vacuum equipment 102 is actuated to transfer vacuum suction force to the vacuum duct 113 through an ejector and a booster. Then, vacuum suction force is transferred to the bottom of the first vacuum vessel 110 with the bottom end immersed in molten steel of the ladle 135 via the first vacuum duct 111*a* communicating with the vacuum duct 113 via the switching duct 114, thereby forcibly sucking and raising molten steel in the first ladle 135.

At the same time, backflow gas is fed to the bottom of the first ladle 135 to cause backflow to molten steel in order to control the composition of molten steel as well as to enable high purity.

In addition, the process of charging ally iron into the first ladle through the first vacuum vessel in order to control the composition of molten steel converts a supplying path by the use of the dispenser 104 installed at the intersection between the first and second charging ducts 104*a* and 104*b* connected to the alloy iron source 103 so that ally iron is into the first vacuum vessel 110 where it is degassed.

Upon the completion of vacuum degassing of molten steel in the first ladle 135, the vacuum equipment 102 is stopped to convert the internal pressure of the first vacuum vessel 110 into the atmospheric pressure, and the raised first lifting cylinder 150 is lowered back to seat the first ladle 135 on the first ladle carriage 130, which is then driven along the first rail to a tapping position.

During repetition of vacuum degassing and tapping for three or four times with respect to the first ladle 135 by the use of the first vacuum vessel 110 as described above, the adjacent second vacuum vessel 120 is subject to replacement or repair. For example, the upper/lower vacuum vessel or the snorkel may be replaced with a new one or the second vacuum vessel may be repaired by the use of a spray gunning machine or a hot frame gunning machine.

On the other hand, in case of attempting to replace the upper/lower vacuum vessel or the snorkel of the first vacuum vessel 110, the second ladle 145 filled with molten steel is located in the treatment position directly under the second vacuum vessel 120, and only the second ladle 145 is elevated by the second lifting cylinder 160 so that the bottom end of the second vacuum vessel 120 is immersed by molten steel in the second ladle 145.

Then, the switching duct 114 is disassembled from between the first exhaust duct 111*a* and the vacuum duct 113 and the disassembled switching duct 114 is displaced to communicate between the second exhaust duct 112*a* and the vacuum duct 114.

In this case, it is possible to perform a degassing process to transfer vacuum suction force occurring in the vacuum equipment 102 to the second vacuum vessel 120 in order to give suction-up and backflow to molten steel in the second ladle 120.

Furthermore, in response to the selective switching of the supply path by the dispenser 104 arranged at the intersection between the first and second charging ducts 104*a* and 104*b*, ally iron supplied from the ally iron source 103 is supplied to the second vacuum vessel 120 to control the composition of molten steel.

While molten steel in the second ladle 145 is being degassed or tapped by the use of the second vacuum vessel 120, the adjacent first vacuum vessel 110 can be subject to replacement or repair. That is, the upper/lower vacuum vessel or snorkel of the first vacuum vessel 110 can be replaced with a new one or the first vacuum vessel 110 can be repaired by using the spray gunning machine or hot frame gunning machine.

While the present invention has been described with reference to the particular illustrative embodiments and the accompanying drawings, it is not to be limited thereto but will be defined by the appended claims. It is to be appreciated that those skilled in the art can substitute, change or modify the embodiments into various forms without departing from the scope and spirit of the present invention.

The invention claimed is:

1. A vacuum degassing apparatus for removing impurity gases from molten steel by backflow of molten steel thereby homogenizing molten steel composition, comprising:

duplex vacuum vessels of first and second vacuum vessels fixedly arranged at a predetermined interval to a floor which is provided horizontally at a predetermined height from a bottom, wherein the first and second vacuum vessels are arranged to communicate with first and second gas coolers, respectively;

first and second ladle carriages arranged to run on first and second rails, respectively, to reciprocate between a treatment position directly under the first and second vacuum vessels and a tapping position where refined molten steel is tapped, each of the first and second ladle carriage loaded with a corresponding one of first and second ladles;

first and second lifting cylinders each for raising and lowering each of the first and second ladles in the treatment position so that a bottom end of each of the first and second vacuum vessels is immersed by molten steel in each of the first and second ladles, whereby a continuous vacuum degassing refining process is enabled;

first and second exhaust ducts extending respectively from the first and second gas coolers;

vacuum duct extending from vacuum equipment and arranged between the first and second exhaust ducts; and switching duct configured to reciprocate between the first exhaust duct and the vacuum duct and between the second exhaust duct and the vacuum duct.

2. The vacuum degassing apparatus according to claim 1 wherein the switching duct comprises an overturned U-shaped duct member connected to a duct carriage by means of a chain member or cylinder, the duct carriage arranged to reciprocate on a horizontal rail.

3. The vacuum degassing apparatus according to claim 1, wherein the first and second vacuum vessels are arranged to communicate with an alloy iron source by means of first and second charging ducts, the apparatus further comprising a dispenser arranged at a point where the charging ducts intersect each other, the dispenser configured to convert a supply path of alloy iron in order to selectively supply alloy iron to one of the first and second vacuum vessels.

4. The vacuum degassing apparatus according to claim 1, wherein the first and second lifting cylinders are arranged in first and second pits, respectively, which are dug to a predetermined depth into bottom portions directly under the first and second vacuum vessels.

* * * * *

UNITED STATES PATENT AND TRADEMARK OFFICE

CERTIFICATE OF CORRECTION

PATENT NO. : 7,976,773 B2
APPLICATION NO. : 12/159615
DATED : July 12, 2011
INVENTOR(S) : Byung-kyu Jung et al.

It is certified that error appears in the above-identified patent and that said Letters Patent is hereby corrected as shown below:

IN THE TITLE PAGE

(87) PCT Pub. Date: Replace "May 7, 2007", with -- July 5, 2007 --

Signed and Sealed this
Third Day of January, 2012

David J. Kappos

David J. Kappos
*Director of the United States Patent and Trademark Office*